United States Patent [19]

Setzer et al.

[11] 4,019,931

[45] Apr. 26, 1977

[54] THREAD PLATE PROCESS

[75] Inventors: William C. Setzer, Creve Coeur, Mo.; Harvey P. Cheskis, New Haven; Michael J. Pryor, Woodbridge, both of Conn.

[73] Assignee: Swiss Aluminium Ltd., Chippis, Switzerland

[22] Filed: Mar. 4, 1976

[21] Appl. No.: 663,760

[52] U.S. Cl. ..... 148/11.5 A; 75/147; 75/148; 148/12.7 A

[51] Int. Cl.[2] ..... C22F 1/04

[58] Field of Search ..... 148/11.5 A, 12.7 A; 75/147, 148

[56] References Cited

UNITED STATES PATENTS

| | | | |
|---|---|---|---|
| 3,418,177 | 12/1968 | Pryor | 148/12.7 A |
| 3,642,542 | 2/1972 | Sperry et al. | 148/12.7 A |
| 3,791,880 | 2/1974 | Hunsicker et al. | 148/11.5 A |

*Primary Examiner*—Arthur J. Steiner
*Attorney, Agent, or Firm*—Robert H. Bachman; Robert A. Dawson

[57] ABSTRACT

The present invention comprises an improved process for the preparation of aluminum base alloys containing magnesium and silicon in wrought form, and particularly as tread plate which includes the steps of casting, homogenizing, hot rolling within a critical temperature and time range and cooling at a rate greater than a critical rate and before a critical delay time after said hot rolling step. The resulting product can be artificially aged without the need for a separate solution heat treatment and possesses improved tensile properties, surface appearance and corrosion resistance.

10 Claims, No Drawings

THREAD PLATE PROCESS

BACKGROUND OF THE INVENTION

The present invention relates to an improved method for the preparation of wroght sheet products such as tread plate from aluminum base alloys containing silicon and magnesium which possess high strength and high impact properties.

The preparation of sheet or plate products from aluminum base alloys is well known. Particularly, the preparation of aluminum tread plate has long been desirable for use in industrial, marine and transportation applications. Aluminum tread plate is generally a sheet or plate product produced with a raised pattern on its surface which provides a non-skid feature. The pattern is usually provided by an embossing operation performed in conjunction with the roll processing of the alloy. Because of its utility, tread plate is generally employed in situations involving substantial loading, and consequently a treat plate product must have sufficient properties to insure safe performance under various design loading conditions. The above properties must also be obtainable with a relative ease of manufacture which would make the preparation of aluminum tread plate commercially desirable.

Conventional processing of aluminum base alloys in this regard, particularly alloys of the 6000 Series containing magnesium and silicon, such as Alloy 6061, has required that the alloy be solution treated and quenched prior to aging to yield a product possessing the required strength levels in service. Solution heat treatment is undesirable because it is costly, time-consuming, requires special equipment and handling and often degrades the surface appearance of the product. In addition, undesirable distortion and residual stresses are developed which must be eliminated by additional processing treatments such as thermal flattening, light roll reductions and/or stretching.

SUMMARY OF THE INVENTION

In accordance with the present invention, a process for the preparation of aluminum base alloys in wrought form possessing improved tensile properties is disclosed which comprises an aluminum base alloy containing magnesium and silicon in the cast condition, homogenizing said alloy at a temperature above 900° F for a period exceeding 6 hours, hot rolling said alloy in excess of 30% reduction at a starting temperature of about 900° F wherein said hot rolling is continued at temperatures below the solubility limit of said alloy and said alloy is held at a temperature of 850° F for a maximum of 4 minutes, is then held at a temperature of 800° F for a maximum of about 2 minutes, and is finally held in the temperature range of from 750° –550° F for a maximum of about 1 minute. The alloy is quenched during hot rolling whereby the temperature is reduced to below 550° F in a maximum of 1 minute. The present invention is particularly useful for the preparation of sheet and plate products such as embossed tread plate which do not require a separate solution heat treatment step.

The present invention further includes the provision of an aluminum base alloy of the 6000 Series containing silicon in an amount from about 0.20 to 1.35%, magnesium in an amount from about 0.3 to 1.5% with the balance essentially aluminum. The alloy of the present invention exhibits the desirable strength and impact properties in conjunction with ease of processing and favorable surface appearance.

Accordingly, it is a principal object of the present invention to provide an improved method for producing sheet products such as tread plate from aluminum base alloys which eliminates the need for solution treatment and quenching to assure adequate response to subsequent age hardening.

It is a further object of the present invention to process an aluminum base alloy of the 6000 Series in the manner aforesaid which provides significant improvement in tensile properties, corrosion resistance and surface appearance over conventional processing of similar aluminum base alloys.

Further objects and advantages will appear from a consideration of the ensuing description.

DETAILED DESCRIPTION

In accordance with the present invention, the foregoing objects and advantages are readily attained.

The present invention comprises a method for the preparation of aluminum base alloys in wrought form, such as embossed tread plate possessing improved tensile properties which comprises providing an aluminum base alloy containing magnesium and silicon in the cast condition, homogenizing said alloy at a temperature of above 900° F for a period greater than 6 hours, conducting a first hot rolling sequence to an excess of 30% reduction at a starting temperature of above 900° F, conducting a second hot rolling sequence at temperatures below the solubility limit of said alloy wherein said alloy resides at the temperature of about 850° F for no more than 4 minutes, 800° F for no more than 2 minutes and within the range of 750°–550° F for no more than about 1 minute. In the preparation of tread plate, the last hot rolling pass in the second hot rolling sequence is conducted between embossing rolls. After this last hot rolling pass, the wrought alloy is then rapidly cooled such that the metal temperature of the alloy throughout its thickness is reduced to below 550° F in less than 1 minute.

A wide variety of aluminum base alloys may be processed in accordance with the present invention to wrought form. The alloys employed herein generally fall within the group designated by the Aluminum Association as the 6000 Series of aluminum base alloys.

These alloys contain as their primary constituents magnesium and silicon, and particularly in amounts of up to about 135% silicon and up to 1.5% magnesium, respectively. These materials are well suited for manufacture into tread plate as they can be solution treated, quenched and aged to high strength levels. More particularly, the alloys contemplated by the present invention contain from 0.20 to 1.35% silicon and from 0.3 to 1.5% magnesium. Further alloys may be present in accordance with the compositional requirements of the 6000 Series, and thus, the alloy may further contain from about 0.05 to about 0.15% manganese, from about 0.05 to about 0.15% chromium and from about 0.05 to about 0.15% zirconium, as well as incidental additions of beryllium, titanium, boron and other elements present in impurity amounts not affecting the properties of the alloy.

The manner of melting and casting employed in accordance with the present invention is not particularly critical, and conventional methods of melting and casting may be conveniently employed. Thus, casting techniques may include the direct chill (DC) casting technique and the tilt mold (Durville) process. A homogenization heat treatment is conducted subsequent to the casting operation which is generally conducted at a temperature of above 900° F, and preferably at a temperature ranging from about 1000°–1050° F, for a time period ranging from about 8 to 14 hours. This homogenization treatment is believed to prevent the precipitation of $Mg_2Si$ during the latter stages of the hot rolling treatment.

After casting and homogenizing, the alloy is hot worked preferably by hot rolling at a starting temperature in excess of 900° F and preferably at a temperature ranging from about 950°–1100° F. This starting temperature is critical in order to avoid massive $Mg_2Si$ precipitation during the latter stages of hot rolling, and, therefore, serves in a similar capacity to that of the previously conducted homogenization heat treatment.

The hot rolling sequence employed in accordance with the present invention is particularly critical as it materially enhances the ease of processing of the alloy to the final product through the avoidance of $Mg_2Si$ precipitates. Particularly, hot rolling must be conducted such that certain residence times at particular temperature levels are strictly observed. That is, during hot rolling, and in order to assure maximum aging response it is critical that the alloy may reside at a temperature of about 850° F for no more than about 4 minutes, after which it should reside at a temperature of about 800° F for no more than about 2 minutes, and finally that it may reside in a temperature range of from about 750°–550° F for no more than about 1 minute. The foregoing hot rolling sequence is further characterized by the employment of a quenching operation at the end thereof, whereby the exiting alloy is reduced in temperature to below 550° F, and said temperature reduction or drop is achieved in no more than 1 minute. This latter step is employed as part of the hot rolling sequence so that the rolled product exiting therefrom is at the aforenoted temperature. It should be emphasized that the foregoing quenching operation is employed and does achieve a full cooling of the rolled alloy throughout its thickness, as the intent herein is to provide a product useful in its final form.

As the process of the present invention is particularly applicable and useful for the manufacture of tread plate, it should be noted that the application of the desired pattern to the strip alloy product may be carried out as part of the hot rolling sequence. Particularly, the last hot rolling pass may be conducted through appropriately configured embossing rolls whereby the desired pattern is then imprinted upon the alloy strip material.

In addition to the above processing, the wrought product prepared in accordance with the present invention may be, if desired, subjected to an additional aging treatment whereby the product is heated in a temperature ranging from about 275° to 450° F for at least 15 minutes. Additional aging will serve to improve even further the tensile and impact properties of the embossed product.

The articles produced in accordance with the present invention are characterized by improved flatness and increased pattern height, since the material entering the embossing roll during the hot rolling sequence is of such temperature that subsequent skin passing need not be conducted to achieve desired surface quality. Further, the employment of the method of the present invention confers improved surface finish without solution heat treatment staining, together with good as-rolled tensile properties as well as increased tensile strength after aging. Typical room temperature impact properties at a yield strength level of 35,000 psi for Alloy 6205 have been found to be 20 ft/lbs. This is particularly advantageous in light of the heavy-duty purposes that many tread plate products are put to.

The process of the present invention and improvements resulting therefrom will be more readily apparent from a consideration of the following illustrative examples.

EXAMPLE I

Ingots were prepared by direct chill (DC) casting in a conventional manner summarized as follows. Melting and alloying was carried out in a gas-fired, open hearth furnace. After alloying the melt was degassed by gaseous chlorine fluxing for 20 minutes. The average pouring temperature was 1370° F. The average casting speed was 4½ inches per minute and the metal head was maintained between 2½ and 3 inches. Four ingots were prepared in this manner which varied in composition and represented, respectively, two samples each of Alloys 6061 and 6205. The ingots were prepared in this manner to enable comparative testing to be conducted as set forth in the examples which follow. The compositions of the respective alloys are set forth in Table I below.

TABLE I

| Alloy No. | COMPOSITION (Wt. %) | | | | | | | | | | |
|---|---|---|---|---|---|---|---|---|---|---|---|
| | Si | Fe | Cu | Mn | Mg | Cr | Zn | Ti | Zr | Be | Al |
| A (Commercial Alloy 6061) | .73 | .54 | .23 | .06 | .97 | .18 | .05 | .023 | — | — | Bal. |
| B (Comparative 6061) | .61 | .37 | .29 | .07 | 1.15 | .17 | .05 | .018 | — | — | Bal. |
| C (Commercial Alloy 6205) | .73 | .49 | .06 | .09 | .40 | .09 | .04 | .026 | .07 | .008 | Bal. |
| D (Comparative 6205) | .67 | .46 | .22 | .11 | .37 | .12 | .04 | .014 | .09 | — | Bal. |

EXAMPLE II

The alloys prepared as in EXAMPLE I were processed in the following manner. The ingots were then treated in various ways as indicated below. All of the ingots were subjected to a homogenization and were reheated for hot rolling. Alloys C and D, representing ingots of Alloys 6205 were given homogenization treatments of 8 and 12 hours, respectively, at temperatures ranging from 1000 to 1050° F. Each of the ingots was then subjected to a hot rolling operation wherein the time and temperature readings were recorded. Alloys A and C, representing ingots of Alloys 6061 and Alloys 6205 processed in accordance with the invention, were hot rolled within the time and temperature limits thereof, whereas, comparative Alloys B and D were hot rolled by conventional mill practice. The alloys processed in accordance with the invention also were given a final quenching treatment as part of the hot rolling sequence. During hot rolling, time and temperature readings were taken for each alloy, and are presented in Table II below.

TABLE II

| HOT ROLLING - TIME - TEMPERATURE PROFILES | | TIME | TEMPERATURE |
|---|---|---|---|
| Alloy A | 96" Mill Entry | 9:24:40 | 925° F |
| | | 9:25:25 | 910° F |
| | | 9:26:10 | 915° F |
| | | 9:27:00 | 915° F |
| | | 9:28:45 | 915° F |
| | Last 96" Pass | 9:30:40 | 900° F |
| | 80" Mill Entry | 9:32:45 | 850° F |
| | 80" Exit Coil (Quenched) | 9:33:05 | 475° F |
| Alloy B | 96" Mill Entry | 10:07:45 | 930° F |
| | | 10:08:35 | 905° F |
| | | 10:09:30 | 905° F |
| | | 10:10:20 | 910° F |
| | Last 96" Pass | 10:11:50 | 910° F |
| | 80" Mill Entry | 10:13:05 | 890° F |
| | 80" Exit (Coil) | 10:13:25 | 590° F |
| Alloy C | 96" Mill Entry | 10:00:41 | 920° F |
| | | 10:01:50 | 905° F |
| | | 10:02:50 | 910° F |
| | | 10:03:55 | 900° F |
| | | 10:04:55 | 895° F |
| | Last 96" Pass | 10:06:00 | 895° F |
| | 80" Mill Entry | 10:07:55 | 845° F |
| | 80" Exit Coil (Quenched) | 10:08:15 | 455° F |
| Alloy D | 96" Mill Entry | 9:21:30 | 950° F |
| | | 9:22:35 | 930° F |
| | | 9:23:20 | 930° F |
| | Last 96" Pass | 9:24:55 | 900° F |
| | 80" Mill Entry | 9:26:25 | 870° F |
| | 80" Exit (Coil) | 9:26:45 | 560° F |

Referring to Table II above, it should be noted that the alloy samples were subjected to rolling which commenced on a 96 inch width, one-stand breakdown mill and was followed and ended on an 80 inch width, three-stand tandem mill, where the rolled product was then quenched in the case of Alloys A and C, and subsequently exited onto a coiling reel. It is further apparent that Alloys A and C were hot rolled at rapidly changing temperatures falling within the maxima outlined in the present invention, and possessed temperatures after quenching falling way below the maximum temperature specified herein.

EXAMPLE III

Two samples of Alloys A, B, C, and D as processed in Example II above were taken from the coils. One sample of each alloy was subjected to an aging treatment comprising a heat treatment at 325° F for 6 hours. After the aging treatments were completed the samples representing the alloys before and after aging were subjected to tensile testing. The respective samples were appropriately tested in duplicate, and the results of these tests are set forth in Tables III and IV, below.

TABLE III

| | | ALLOYS BEFORE AGE | | |
|---|---|---|---|---|
| Alloy | Sample | UTS/psi | YS/psi | % Elongation |
| A | 1 | 30.4 | 26.3 | 8.0 |
| A | 2 | 30.7 | 26.1 | 11.0 |
| B | 1 | 27.5 | 22.0 | 10.0 |
| B | 2 | 26.9 | 22.0 | 11.0 |
| C | 1 | 32.3 | 29.8 | 12.0 |
| C | 2 | 32.3 | 29.9 | 12.0 |
| D | 1 | 21.4 | 17.6 | 15.0 |
| D | 2 | 21.5 | 17.4 | 15.0 |

TABLE IV

| | | ALLOYS AFTER AGE | | |
|---|---|---|---|---|
| Alloy | Sample | UTS/psi | YS/psi | % Elongation |
| A | 1 | 30.5 | 27.0 | 10.0 |
| A | 2 | 30.8 | 26.8 | 10.0 |
| B | 1 | 26.6 | 21.4 | 10.0 |
| B | 2 | 26.3 | 21.2 | 10.0 |
| C | 1 | 32.5 | 30.2 | 11.0 |
| C | 2 | 32.9 | 31.0 | 12.0 |
| D | 1 | 21.2 | 17.6 | 12.0 |
| D | 2 | 21.1 | 18.0 | 12.0 |

Referring to Tables III and IV above, the alloy samples processed in accordance with the present invention exhibit higher tensile properties than those subjected to conventional processing. Further, aging response was more noticeable and favorable in the alloy samples of the invention while those samples conventionally processed exhibited little or no improvement in properties as a result of the aging treatment.

As noted earlier, the processing of the present invention employs a quenching treatment which is conducted after the final hot rolling pass while the alloy is in the hot rolling mill. This quenching treatment can be conducted in a manner conventional in the art, and is usually accomplished by a water spray directed against the moving alloy. Quenching may also be conducted by passing the hot rolled alloy through an open ended trough fed by an upward flow of water. The particular type of quenching procedure is not critical to the invention per se, and the invention should not be limited thereby.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for the preparation of aluminum base alloys in wrought form possessing improved tensile properties which consists of:

A. providing an aluminum base alloy containing up to about 1.5% magnesium and up to 1.35% silicon in the cast condition;

B. homogenizing said alloy at a temperature above 900° F for a period of from 8–14 hours;

C. hot rolling said alloy in excess of 20% reduction at a starting temperature of above 900° F;

D. continuously hot rolling said alloy at temperatures below the solubility limit thereof, during which said alloy is held for no more than about 4 minutes at a temperature of about 850° F, no more than about 2 minutes at a temperature of about 800° F and no more than about 1 minute in the temperature range of from about 750°–550° F, and quenching the alloy whereby the temperature of said alloy is reduced to below 550° F in no more than 1 minute.

2. The method of claim 1 wherein said alloy comprises from about 0.20–1.35% silicon, and from about 0.3–1.5% magnesium, balance essentially aluminum.

3. The method of claim 3 wherein said alloy further comprises from about 0.05 to about 0.15% manganese, from about 0.05 to about 0.15% chromium and from about 0.05 to about 0.15% zirconium.

4. The method of claim 1 wherein said alloy is homogenized at a temperature ranging from about 1000–1050° F.

5. The method of claim 1 wherein said hot rolling is conducted at a starting temperature of from about 950–1100° F.

6. The method of claim 1 wherein said hot rolling is conducted in excess of 30% reduction.

7. The method of claim 1 wherein said hot rolling employs as a last rolling step prior to said quenching passing said alloy through embossing rolls.

8. The method of claim 7 wherein said wrought form comprises tread plate.

9. A method for the preparation of aluminum base alloys in wrought form possessing improved tensile properties which consists of:

A. providing an aluminum base alloy containing up to about 1.5% magnesium and up to 1.35% silicon in the cast condition;

B. homogenizing said alloy at a temperature above 900° F for a period of from 8–14 hours;

C. hot rolling said alloy in excess of 20% reduction at a starting temperature of above 900° F;

D. continuously hot rolling said alloy at temperatures below the solubility limit thereof, during which said alloy is held for no more than about 4 minutes at a temperature of about 850° F, no more than about 2 minutes at a temperature of about 800° F and no more than about 1 minute in the temperature range of from about 750°–550° F;

E. quenching the alloy whereby the temperature of said alloy is reduced to below 550° F in no more thabn 1 minute; and F. subjecting the alloy to an aging treatment.

10. The method of claim 9 wherein said aging treatment comprises heat treating said hot rolled alloy for at least 15 minutes at a temperature ranging from about 275°–450° F.

* * * * *

UNITED STATES PATENT OFFICE

CERTIFICATE OF CORRECTION

PATENT NO. : 4,019,931

DATED : April 26, 1977

INVENTOR(S) : William C. Setzer, Harvey P. Cheskis & Michael J. Pryor

It is certified that error appears in the above-identified patent and that said Letters Patent are hereby corrected as shown below:

In Column 1, line 6, change "wroght" to --wrought--.

In Column 1, line 21, change "treat" to --tread--.

In Column 1, line 50, change "about" to --above--.

In Column 1, line 55, change "750° -550°" to --750°-550°--.

In Column 2, line 49, change "135%" to --1.35%--.

In Column 6, line 66, after the word "and" a new paragraph should begin and the letter --E.-- should be inserted before the words "quenching the"

In Column 7, line 4, after the word "claim" change the numeral "3" to --2--.

UNITED STATES PATENT OFFICE

CERTIFICATE OF CORRECTION

Patent No. 4,019,931 Dated April 26, 1977

Inventor(s) William C. Setzer et al.

It is certified that error appears in the above-identified patent and that said Letters Patent are hereby corrected as shown below:

In Column 8, line 17, change "thabn" to -- than --.

Signed and Sealed this ninth Day of August 1977

[SEAL]

Attest:

RUTH C. MASON
*Attesting Officer*

C. MARSHALL DANN
*Commissioner of Patents and Trademarks*